United States Patent [19]

Drach et al.

[11] 4,431,481

[45] Feb. 14, 1984

[54] MODIFIED CELLULOSIC FIBERS AND METHOD FOR PREPARATION THEREOF

[75] Inventors: John E. Drach, Montgomery County, Pa.; Cleveland O'Neal, Jr., Camden County, N.J.

[73] Assignee: Scott Paper Co., Philadelphia, Pa.

[21] Appl. No.: 363,167

[22] Filed: Mar. 29, 1982

[51] Int. Cl.[3] ..... D21H 3/38

[52] U.S. Cl. ..... 162/100; 162/9; 162/157.6; 162/164.6; 162/166; 162/167; 162/168.2; 162/182; 162/201

[58] Field of Search ..... 162/9, 168.2, 201, 100, 162/182, 157.6, 164.6, 166, 167; 428/290; 526/304; 8/194

[56] References Cited

U.S. PATENT DOCUMENTS

| | | | |
|---|---|---|---|
| 3,275,605 | 9/1966 | Eastes et al. | 260/70 |
| 3,756,913 | 9/1973 | Wodka | 162/183 |
| 3,819,470 | 6/1974 | Shaw et al. | 162/157 C |
| 4,284,758 | 8/1981 | North | 528/245 |

*Primary Examiner*—Peter Chin

*Attorney, Agent, or Firm*—John A. Weygandt

[57] ABSTRACT

Cellulosic fibers, characterized by a lack of swellability and incapable of natural fiber-to-fiber bonding, are produced by a process which comprises treating an aqueous slurry of the fibers with a formaldehyde-free polymeric compound, heating the treated fibers to cause the polymeric compound to react with the fibers, and refiberizing to separate individual, treated fibers. The fibers are useful in the preparation of improved cellulosic webs characterized primarily by their increased bulk and improved softness.

15 Claims, No Drawings

MODIFIED CELLULOSIC FIBERS AND METHOD FOR PREPARATION THEREOF

BACKGROUND OF THE INVENTION

1. Field of the Invention

The present invention relates, generally, to modified cellulosic fibers, to a process for preparing said fibers, and to improved cellulosic webs containing said fibers. More particularly this invention relates to cellulosic fibers characterized by a lack of swellability and incapable of natural fiber-to-fiber bonding produced by treating an aqueous slurry of the fibers with a polymeric compound, heating the treated fibers to cause the polymeric compound to react with the fibers, and refiberizing to separate individual, treated fibers. Paper products having improved properties, such as bulk and softness, absorbency are prepared from a furnish comprising these treated fibers in combination with normal paper-making fibers.

2. Description of the Prior Art

In a conventional paper-making operation cellulosic fibers are dispersed in water, drained on a wire screen, pressed into close physical contact and dried. The result is a paper sheet in which the individual fibers are held together by hydrogen bonds which give strength to the dry sheet. When the dry sheet is wet, these hydrogen bonds are broken and the paper loses most of its strength. To prevent this strength loss, various chemical treatments have been employed. Among the most successful treatments is the use of synthetic resins which, when added to the cellulosic fibers, either before or after a sheet is formed therefrom, and cured or polymerized, can significantly increase the wet strength of the sheet. Most commonly used are the urea-formaldehyde and melamine-formaldehyde type resins. These resins, because they are cationic, are easily deposited on, and retained by, the anionic paper-making fibers.

Cellulosic fibers when dispersed in water in the normal paper-making operation, absorb water and thereby swell. When formed into a sheet and pressed the fibers revert to their natural, unswollen state. In this dried condition, the fibers bond to each other through hydrogen bonding producing a stiff, compact web. It is very often desirable to produce webs which are bulkier and more absorbent than those produced via the conventional paper-making process. Such webs are used in the manufacture of sanitary products such as napkins, tissues, diapers and sanitary pads.

A low cost method of producing absorbent bulky webs encompasses the mixing of chemically modified fibers with normal, untreated fibers in the paper-making process. One way of producing these chemically modified fibers involves the crosslinking of the cellulose molecules within the fibers.

Preparation methods include for example the impregnation of cellulosic fibers with monomeric crosslinking agents, followed by heating to cause a cross-linking reaction to take place. Known techniques are identified in Shaw et al. U.S. Pat. No. 3,819,470, column 2, lines 18–28. Other methods include the treatment of cellulosic fibers with a substantive polymeric compound capable of reaction with the cellulose and/or itself. Wodka in U.S. Pat. No. 3,756,913 at column 3, lines 32–38 suggests that any of the water-soluble, thermosetting, cationic resins well-known in the art for increasing the wet strength of cellulosic sheet materials and including, for example, urea-formaldehyde resins, glyoxal-acrylamide resins, and polyamide-epichlorohydrin resins may be used for treating cellulosic fibers. Said disclosure of U.S. Pat. No. 3,756,913 might lead one of ordinary skill in the art to assume that all polymeric materials capable of increasing the wet strength of cellulosic web materials would be equally effective in producing chemically modified fibers. The present inventors, in their search for a formaldehyde-free resin capable of modifying cellulosic fibers have found that not all formaldehyde-free wet strength resins are as effective as may be desired for a commercially acceptable product. Specifically, North, in U.S. Pat. No. 4,284,758 describes a formaldehyde-free resinous product as being effective in increasing the wet strength of paper. (Column 3, lines 42–44). When the present inventors applied this resin to cellulosic fibers for the purpose of producing bulky and absorbent sheets, only a very limited modification was obtained.

Unexpectedly, the present inventors have found that a copolymer which is not thermosetting, and therefore incapable of crosslinking with itself, can be used to modify cellulosic fibers so as to render them non-bonding. Such a copolymer is completely free of formaldehyde and epichlorohydrin and cures by reaction with cellulose, an entirely different mechanism from that of the resin crosslinking with itself as in the case of the conventional, commercially available wet strength resins.

SUMMARY OF THE INVENTION

In accordance with the present invention, cellulosic fibers, characterized by being incapable of natural fiber-to-fiber bonding, are produced by a process which comprises treating an aqueous slurry of the fibers with a amic acid copolymer, heating the treated fibers to cause the polymeric compound to react with the fibers, and refiberizing to separate individual treated fibers. Paper products having improved properties, such as bulk and softness, are prepared from a furnish comprising these treated fibers in combination with normal paper-making fibers. Such fibers are frequently referred to in the art as "bulking" fibers.

The amic acid copolymer for use in the present invention is disclosed as a wet strength resin in copending, commonly assigned patent application Ser. No. 286 078 filed July 24, 1981. In accordance with the teaching of said copending application, water soluble copolymers containing the half acid, half amide structure of amic acids can be used to increase the wet strength of paper. These copolymers comprise (A) a half-acid, half-amide corresponding to the following general formula $$NH_2-\underset{\underset{O}{\|}}{C}-R-\underset{\underset{O}{\|}}{C}-OR^1$$

wherein $R^1$ is H, alkyl or alkenyl and R is a hydrocarbon chain which has radically polymerized with (B) at least one other ethylenically unsaturated monomer.

These water soluble amic acid copolymers can be prepared by reacting an anhydride-containing precursor copolymer with ammonia, namely by adding it to aqueous ammonia, thereby producing an amic acid-containing copolymer. The resulting amic acid copolymer solution can then be applied to a cellulosic web, such as paper, by a variety of methods including coating, spraying, printing and the like. The amic acid copolymers useful in this invention can also be prepared by copolymerizing an ethylenically unsaturated amic acid and at least one other ethylenically unsaturated monomer.

If it is desired that the copolymer be substantive to cellulose, copolymers can be made by reacting an ethylenically unsaturated amic acid and at least one other ethylenically unsaturated monomer and at least one other ethylenically unsaturated basic nitrogen-containing monomer. The basic nitrogen-containing monomer will impart a cationic character to the copolymer which makes it attractive to anionic cellulose fibers for deposition in the wet end of a paper machine. Suitable examples of the other ethylenically unsaturated, basic nitrogen-containing monomer include N,N-dimethylaminoethylmethacrylate, N,N-diethylaminoethylmethacrylate, N,N-dimethylaminoethylacrylate, N,N-diethylaminoethylacrylate, 2-vinylpyridine, 4-vinylpyridine, and N-(t-butyl)-aminoethylmethacrylate.

The ethylenically unsaturated amic acid useful in synthesizing these cellulose-substantive polymers are polymerizable compounds of the following general formula

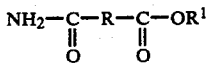

wherein R is a hydrocarbon chain containing a multiple bond capable of radical polymerization and $R^1$ is H, alkyl or alkenyl. The amount of the amic acid which can be used along with the other monomeric species to make up the desired amic acid copolymer must be chosen so as to render the resulting copolymer water soluble. Depending upon the nature of the other comonomers, this amount can range from 5% to 50% by weight of the copolymer.

The other ethylenically unsaturated monomers useful in synthesizing the desired amic acid precursor polymer include acrylic and/or methacrylic acids and/or their esters, amides, substituted amides, and nitriles. Also useful are esters of vinyl alcohol, vinyl ethers and ketones, acrolein, styrene and substituted styrenes, vinyl pyridines, ethylene, butadiene, maleic, fumaric and itaconic acids and esters and substituted amides, polymerizable derivatives of allyl alcohol, vinylacetic acid and the like.

The polymerization of these monomers to yield water soluble copolymers can be accomplished by well known polymerization techniques as described in such chemistry texts as POLYMER SYNTHESIS, Volume I, II, and III, by Stanley R. Sandler and Wolf Karo, Academic Press, New York and London (1974), and PREPARATIVE METHODS OF POLYMER CHEMISTRY, second edition, by Wayne R. Sorenson and Tod W. Campbell, Interscience Publishers (John Wiley & Sons), New York (1968).

The resins as described in this disclosure are applied to cellulosic fibers prior to web formation. The resin, can be added to a slurry of fibers, as in the wet end of a paper machine. If the resin does not bear a net positive charge and therefore is not substantive to cellulose, economic considerations will probably require that the resin solution be recirculated for re-use in treating the fibers. The amount of resin consumed, i.e. taken away on the fibers, is replenished during the recycling process. The amount of resin added to the fibers can vary, depending upon the degree of modification desired. The preferred amount of resin to be added to the fibers is in the range of 3 to 8% based upon weight of fiber. The curing or crosslinking reaction can be accelerated by the addition of mineral acids or salts of such acids such as ammonium, magnesium, zinc and tin chlorides, nitrates or sulfates.

DESCRIPTION OF THE PREFERRED EMBODIMENTS

The polymer composition of this invention is a water soluble addition copolymer of an ethylenically unsaturated amic acid and at least one other ethylenically unsaturated monomer. Preferably, the ethylenically unsaturated amic acid is (I) maleamic acid, (Z)-4-amino-4-oxo-2-butenoic acid

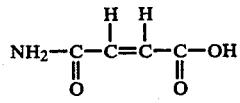

(II) fumaramic acid, (E)-4-amino-4-oxo-2-butenoic acid

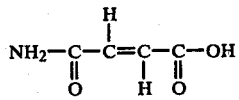

or (III) itaconamic acid, 4-amino-4-oxo-2-methylene butanoic acid

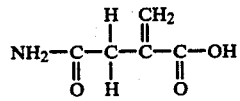

Among the other ethylenically unsaturated monomers useful in this invention are the vinyl esters of aliphatic acids which have one to ten carbon atoms. The preferred vinyl ester is vinyl acetate especially when used with esters of acrylic or methacrylic acids. The acrylate and methacrylate esters of alkyl and cycloalkyl alcohols having one to twenty carbon atoms are most efficacious in forming useful copolymers with vinyl acetate. The preferred esters of methacrylic acid are methyl, ethyl, n-propyl, n-butyl, iso-butyl, 2-ethylhexyl esters. The preferred esters of acrylic acid are methyl, ethyl, n-propyl, n-butyl, iso-butyl, 2-ethyl hexyl with n-butyl being the most preferred.

Most preferably the copolymer is composed of 80–98% by weight acrylamide, 1–10% by weight N,N-dimethylaminoethyl methacrylate, and 1–10% maleamic acid. The preferred copolymer is prepared by the addition polymerization of the respective monomers by a standard method as outlined in the chemistry texts aforementioned.

Another preferred method of making a copolymer as described in this invention is to transform an existing copolymer into an amic acid copolymer. This is done by adding an anhydride-containing copolymer to aqueous ammonia to form an amic acid copolymer.

Thus the copolymers of this invention are also formed as the products of the reaction of an anhydride-containing copolymer and aqueous ammonia. These anhydride-containing copolymers have a general formula -comonomer-anhydride-comonomer-anhydride-comonomer-anhydride- The anhydride-containing copolymer as described by the above general formula is the product of the addition polymerization reaction of an ethylenically unsaturated, polymerizable anhydride and at least one other ethylenically unsaturated monomer.

The ethylenically unsaturated, polymerizable anhydride used to synthesize the anhydride-containing copolymer is a cyclic anhydride containing a polymerizable multiple bond capable of radical polymerization. Most preferably the cyclic anhydride is maleic anhydride or itaconic anhydride.

Among the other ethylenically unsaturated monomers used to make the anhydride-containing copolymer are the vinyl esters of aliphatic acids which have one to ten carbon atoms; alkyl vinyl ethers which have alkyl groups composed of from one to ten carbon atoms and whose alkenyl groups are composed of from one to ten carbon atoms; alkenes; and alkadienes which have from one to ten carbon atoms.

The preferred vinyl esters of aliphatic acids are vinyl acetate and vinyl propionate. The preferred alkyl vinyl ethers are methyl vinyl ether, ethyl vinyl ether, butyl vinyl ether and propyl vinyl ether. The preferred alkene and/or alkadiene are ethylene, propylene, 1-butene, 2-butene and 1,3-butadiene.

The intrafiber crosslinking of the cellulose molecules is accomplished by the reaction of the maleamic acid copolymer with the cellulose molecules. More specifically, the pendent amide functionalities of the maleamic acid copolymer react with the hydroxyl groups of the cellulose molecules forming ester crosslinks between the maleamic acid copolymer and any adjacent cellulose chains within an individual fiber.

In accordance with the preferred embodiment of present invention, modified cellulosic fibers are prepared by a four step process. In the first step, the cellulose is slurried in an aqueous solution of the maleamic acid copolymer. Secondly, the treated fibers are dewatered and dried. Following drying, the cellulosic fibers are refiberized. Finally, the fluffed fibers are heated to cause reaction of the polymeric compound with the cellulose.

It has been found that many cellulosic fibers normally used in paper-making operations can be employed in carrying out the present invention. These include chemical pulps (i.e. Kraft, sulfate, and sulfite) dried or never-dried, and secondary fibers.

An aqueous solution of maleamic acid copolymer at a concentration of from 1% to 2% was employed to treat the cellulosic fibers. To this resin solution is added sufficient acid (preferably sulfuric acid) to reduce solution pH to the range of 4.0 to 6.0. It is believed that the acid acts as a catalyst to accelerate the reaction of the polymeric compound during the curing step.

Also, to assist in the production of individual modified fibers with a minimum expenditure of energy, a compound which will aid in the refiberizing step may be added. Chemicals which have been found to be especially useful for this purpose include imidazolinium compounds and quaternary ammonium salts. The quantity of these debonders used in the present invention is not critical; it is preferable to add them in an amount equal to from about 0.1% to about 1.5% of the bone-dry weight of the fibers. After the chemicals have been added, the slurry is agitated for a time and dewatered by vacuum or centrifugal extraction. It is especially preferred to remove water until the fibers are at a consistency of approximately 40% solids.

The treated and dewatered fibers are then dried in an oven at 110° C. for two hours. The drying could be carried out at room temperature (e.g. overnight) if a shorter time interval is not desired.

The dried, treated wood pulp fibers are refiberized (fluffed) in a suitable device such as a Waring Blender for about 20 to 30 seconds.

Fibers produced by the above process are useful in the preparation of webs characterized by their improved bulk and softness as well as their reduced tensile strength and improved calpier, absorbency and opacity. To prepare such webs, modified fibers prepared in accordance with the present invention are employed in combination with normal, untreated, cellulosic, papermaking fibers. The modified fibers are employed in an amount equal to from 20% to 80% of the total fibers employed.

An outstanding advantage in using maleamic acid copolymers in the preparation of crosslinked fibers as described in this invention is that there is no formaldehyde present. Therefore none can be released during any web application process or subsequent curing step in the treatment process. This is an important advantage over commercially available wet strength resins such as urea-formaldehyde and/or melamine-formaldehyde resins which do release formaldehyde in their curing or crosslinking steps. The elimination of formaldehyde thus assures that users of products made with these copolymers and/or workers involved in producing such products, will not be exposed to formaldehyde and therefore cannot suffer any irritation which might be attributable to it.

In order to describe the present invention so that it may be more clearly understood, the following examples are set forth. These examples are set forth primarily for the purpose of illustration, and any enumeration of detail contained therein should not be interpreted as a limitation on the concept of this invention.

EXAMPLE 1

A sufficient quantity of maleamic acid copolymer was added to one liter of water in a British disintegrator to make a 1% solution. Thirty grams of sulfite wood pulp was slurried in the resin solution, then 0.5% debonder (based on weight of fiber) was added. Following this step a sufficient quantity of sulfuric acid was stirred in to lower the pH to about 4.0. Total mixing time in the disintegrator was about ten minutes. The slurry was subsequently poured through a Buchner funnel attached to an aspirator. Water was extracted until the fibers were about 40% dry.

The treated pulp pad was removed from the funnel and dried in an oven for two hours at 110° C. (230° F.). The dried pulp pad (broken in pieces) was fiberized in a Waring Blender in small batches for about 20 seconds per batch. The fluffed pulp was then placed in an oven at 149° C. (300° F.) for six minutes to cure the maleamic acid copolymer "MAC" on the individual fibers. The foregoing procedure was repeated using a 2% copolymer solution. Handsheets of these fibers were made and caliper and tensile were determined. The basis weight of the handsheets was 51 grams per square meter or 30 pounds per ream of 2880 sq.ft. The above procedure was repeated using two different wet-strength resins: SUNREZ 700FF, a formaldehyde-free reaction product of glyoxal and cyclic ureas disclosed in U.S. Pat. No. 4,284,758, and "UFC" a cationic, amine-modified urea-formaldehyde resin or condensate, the preparation of which is best represented by Example 1 of U.S. Pat. No. 3,275,605. In the case of these latter two resins the concentration of resins in the treatment solution was 5% based on the weight of the fiber treated. The results are presented in Table 1, wherein "% resin" is the ratio of of the resin retained on the fiber to the weight of the fiber, expressed as percent. In respect of MAC the percent resin retained was determined by measurement in the case of the 2% solution and by extrapolation in the case of the 1% solution. For urea-formaldehyde, the retention was assumed to be 50% of the resin available because extensive experience in the use of this resin has shown this rate to be generally true. For SUNREZ the retention is an estimate based upon data pertaining to other formaldehyde-free wet-strength resins, the actual value being unknown.

TABLE 1

Calipers and Tensiles of Treated Handsheets

| % RESIN | CALIPER (mm × $10^2$) | TENSILE (g/cm) |
|---|---|---|
| 0.0 control | 13.97 | 271.8 |
| 3.7 MAC (1% soln) | 20.57 | TOO WEAK TO TEST |
| 7.4 MAC (2% soln) | 22.86 | TOO WEAK TO TEST |
| 2.5 SUNREZ | 17.02 | 84.83 |
| 2.5 UFC | 24.38 | TOO WEAK TO TEST |

It can be seen from Table 1 that, at the levels of addition employed and particularly using a 2% solution, the maleamic acid copolymer is quite effective in modifying wood pulp fibers. Indeed, its effect is comparable to that of the urea/formaldehyde resin. SUNREZ, the reaction product of glyoxal and cyclic ureas, while capable of modifying the fibers, produces a result which is insufficient to justify the cost of the resin. Despite the disparity in weight retention the above is considered to be a fair comparison because of the lack of substantivity of the maleamic acid copolymer. While more of this particular copolymer is retained it is likely that a substantial portion of the copolymer is not attached to the cellulose and consequently is not effective in modifying the fibers. SUNREZ, however, is described in said U.S. Pat. No. 4,284,758 and is offered for sale as a wet strength resin. When employed at a level at which similar resins are known to produce satisfactory results, it does not. It is on this basis that the present inventors assert that the utility of a wet strength resin for fiber modification cannot be predicted with certainty. Without wishing to be bound by theory, especially since the mechanism of modification is not understood, the present inventors speculate that a substantive maleamic acid copolymer would perform like the urea-formaldehyde condensate at a comparable level of retention.

EXAMPLE 2

Some of the material made in Example 1 was blended with untreated sulfite wood pulp. In the case of the maleamic acid copolymer, fibers treated in the 2% resin solution were chosen. Handsheets comprising 50% modified fiber and 50% untreated fiber were made and several properties were measured. These blended sheets had a basis weight of 77 grams per sq.meter (45 lbs/2880 sq.ft.). Untreated sulfite wood pulp handsheets were also produced for comparison purposes. In Table 2, the measured properties indicate that the sheets containing treated fibers are bulkier, weaker and absorb more water than the untreated control handsheet. In the present case weakness is considered a desirable attribute as it contributes to the perceived softness of the sheet. Total water absorption "TWA" is reported in grams of water absorbed per square meter of sheet.

TABLE 2

Blended Handsheet Data
50% Modified Fiber/50% Untreated Fiber

| RESIN | CALIPER (mm × $10^2$) | SPEC. VOL. (cc/g) | TENSILE (g/cm) | TWA ($g/m^2$) |
|---|---|---|---|---|
| None (control) | 23.82 | 3.13 | 356.94 | 266.36 |
| MAC (2% soln) | 31.22 | 3.95 | 139.41 | 392.28 |
| SUNREZ | 27.43 | 3.39 | 214.30 | 296.88 |
| UFC | 26.42 | 3.43 | 118.98 | 405.26 |

It is seen from Table 2 that maleamic acid copolymer modified fibers impart improvements in the above described properties of a sheet when blended with untreated fiber. Moreover it is seen that the tensile strength and absorbency achieved with the copolymer of the present invention approach those achieved with a cationic, amine-modified urea-formaldehyde resin. The tensile strength and absorbency attained with the commercially available, formaldehyde free resin, SUNREZ, however, represent significantly smaller improvements over the untreated control.

It is apparent that other variations and modifications may be made without departing from the present invention. Accordingly, it should be understood that the forms of the present invention described above are illustrative only and not intended to limit the scope of the invention as defined by the appended claims.

What is claimed is:

1. The method of preparing modified cellulosic fibers which comprises:

treating an aqueous slurry of cellulosic fibers with an amic copolymer comprised of (A) a half-acid, half-amide corresponding to the following general formula:

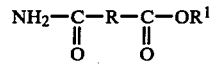

wherein $R^1$ is H and R is a hydrocarbon chain which has radically polymerized with (B) at least one other ethylenically unsaturated monomer, dewatering and drying the treated fibers to cause the copolymer to react with the fiber under conditions wherein the fibers are relatively free from contact with one another, and refiberizing the treated and dried fibers under dry conditions to separate individual fibers.

2. A method in accordance with claim 1, in which the cellulosic fibers are wood pulp fibers.

3. A method in accordance with claim 1, utilizing a copolymer wherein the half-acid, half-amide corresponding to the general formula is maleamic acid.

4. A method in accordance with claim 1, utilizing a copolymer wherein the half-acid, half-amide corresponding to the general formula is fumaramic acid.

5. A method in accordance with claim 1, utilizing a copolymer wherein the half-acid, half-amide corresponding to the general formula is itaconamic acid.

6. A method in accordance with claim 1, utilizing a copolymer wherein the other ethylenically unsaturated monomer comprises a vinyl ester of an aliphatic acid having one to ten carbon atoms.

7. The method according to claim 6, wherein said monomer is vinyl acetate.

8. The method according to claim 7, wherein the copolymer further includes esters of acrylic or methacrylic acids.

9. A method according to claim 1, wherein the copolymer comprises an ethylenically unsaturated, basic nitrogen containing monomer.

10. A method according to claim 1, wherein the half-acid, half-amide comprises from 1 to 10% by weight of the copolymer.

11. A method, as claimed in claim 1, in which the copolymer is added to the fibers in an amount equal to from 3% to 8% of the bone dry weight of the fibers.

12. A method, as claimed in claim 1, in which the pH of the fiber slurry is maintained at from about 4.0 to about 6.0 during the addition of the polymeric compound.

13. A method, as claimed in claim 12, in which the pH is maintained by the addition of a mineral acid.

14. A method, as claimed in claim 1, in which a surface active agent is added to the aqueous fiber slurry.

15. A method, as claimed in claim 14, in which the surface active agent is added to the fiber slurry in an amount equal to from about 0.1% to about 1.5% of the bone dry weight of the fibers.

* * * * *